US007800544B2

(12) United States Patent
Thornell-Pers

(10) Patent No.: US 7,800,544 B2
(45) Date of Patent: Sep. 21, 2010

(54) CONTROLLABLE MULTI-BAND ANTENNA DEVICE AND PORTABLE RADIO COMMUNICATION DEVICE COMPRISING SUCH AN ANTENNA DEVICE

(75) Inventor: Anders Thornell-Pers, Åkersberga (SE)

(73) Assignee: Laird Technologies AB, Kista (SE)

( * ) Notice: Subject to any disclaimer, the term of this patent is extended or adjusted under 35 U.S.C. 154(b) by 476 days.

(21) Appl. No.: 10/578,699

(22) PCT Filed: Oct. 22, 2004

(86) PCT No.: PCT/SE2004/001533

§ 371 (c)(1),
(2), (4) Date: Mar. 7, 2007

(87) PCT Pub. No.: WO2005/048403

PCT Pub. Date: May 26, 2005

(65) Prior Publication Data

US 2007/0241970 A1 Oct. 18, 2007

(30) Foreign Application Priority Data

Nov. 12, 2003 (SE) ..... 0302979

(51) Int. Cl.
*H01Q 1/24* (2006.01)
*H01Q 1/38* (2006.01)
*H01Q 3/24* (2006.01)

(52) U.S. Cl. ..... 343/702; 343/700 MS; 343/876

(58) Field of Classification Search ..... 343/702, 343/700 MS, 867, 722
See application file for complete search history.

(56) References Cited

U.S. PATENT DOCUMENTS

| | | | |
|---|---|---|---|
| 6,061,025 | A | 5/2000 | Jackson et al. |
| 2007/0241970 | A1 | 10/2007 | Thornell-Pers |

FOREIGN PATENT DOCUMENTS

| | | |
|---|---|---|
| CN | 2293923 Y | 10/1998 |
| GB | 2 335 798 | 9/1999 |
| JP | 9326633 | 3/1998 |
| JP | 10-190-344 | 10/1998 |

(Continued)

OTHER PUBLICATIONS

2 Pages of the International Search Report, Feb. 17, 2005.

(Continued)

*Primary Examiner*—Hoang V Nguyen
*Assistant Examiner*—Robert Karacsony
(74) *Attorney, Agent, or Firm*—Harness, Dickey & Pierce, P.L.C.

(57) ABSTRACT

A multi-band antenna device for a portable radio communication device has first and second radiating elements (10, 20'). A controllable switch (30) is arranged between the radiating elements for selectively interconnecting and disconnecting thereof. The state of the switch is controlled by means of a control voltage input (VSwitch). A filter (40) comprising a pure resistance that blocks radio frequency signals is arranged between the second radiating element and the control voltage input. By means of this arrangement, two broad and spaced apart frequency bands are obtained with retained performance and small overall size of the antenna device. A communication device comprising such an antenna device is also provided.

20 Claims, 3 Drawing Sheets

FOREIGN PATENT DOCUMENTS

| | | | |
|---|---|---|---|
| JP | 10-190345 | | 10/1998 |
| JP | 2000236209 | * | 8/2000 |
| WO | WO 0102078 A1 | | 3/2001 |
| WO | WO 2005/048403 | | 10/2004 |
| WO | WO2005/048403 | | 10/2004 |

OTHER PUBLICATIONS

International Bureau, "Notification Concerning Transmittal of International Preliminary Report on Patentability (Chapter I of the Patent Cooperation Treaty" May 26, 2006.

Office Action, dated Jun. 4, 2004, issued in Korean Patent Application Serial No. 10-2006-7007866.

Office Action, dated Jul. 3, 2009, issued in Chinese Patent Application Serial No. 200480033434.6.

Office Action, dated Feb. 5, 2010, issued in Chinese Patent Application Serial No. 200480033434.6.

Office Action, dated Jun. 4, 2010, issued in Swedish Patent Application No. 0302979-0.

* cited by examiner

CONTROLLABLE MULTI-BAND ANTENNA DEVICE AND PORTABLE RADIO COMMUNICATION DEVICE COMPRISING SUCH AN ANTENNA DEVICE

FIELD OF INVENTION

The present invention relates generally to antenna devices and more particularly to a controllable internal multi-band antenna device for use in portable radio communication devices, such as in mobile phones. The invention also relates to a portable radio communication device comprising such an antenna device.

BACKGROUND

Internal antennas have been used for some time in portable radio communication devices. There are a number of advantages connected with using internal antennas, of which can be mentioned that they are small and light, making them suitable for applications wherein size and weight are of importance, such as in mobile phones.

However, the application of internal antennas in a mobile phone puts some constraints on the configuration of the antenna, such as the dimensions of the radiating element or elements, the exact location of feeding and grounding portions etc. These constraints may make it difficult to find a configuration of the antenna that provides a wide operating frequency band. This is particularly important for antennas intended for multi-band operation, wherein the antenna is adapted to operate in two or more spaced apart frequency bands. In a typical dual band phone, the lower frequency band is centered on 900 MHz, the so-called GSM 900 band, whereas the upper frequency band is centered around 1800 or 1900 MHz, the DCS and PCS band, respectively. If the upper frequency band of the antenna device is made wide enough, covering both the 1800 and 1900 MHz bands, a phone operating in three different standard bands is obtained. In the near future, antenna devices operating four or even more different frequency bands are envisaged.

The number of frequency bands in passive antennas is limited by the size of the antenna. To be able to further increase the number of frequency bands and/or decrease the antenna size, active frequency control can be used. An example of active frequency control is disclosed in the Patent Abstracts of Japan 10190347, which discloses a patch antenna device capable of coping with plural frequencies. To this end there are provided a basic patch part and an additional patch part which are interconnected by means of PIN diodes arranged to selectively interconnect and disconnect the patch parts. Although this provides for a frequency control, the antenna device still has a large size and is not well adapted for switching between two or more relatively spaced apart frequency bands, such as between the GSM and DCS/PCS bands. Instead, this example of prior art devices is typical in that switching in and out of additional patches has been used for tuning instead of creating additional frequency band at a distance from a first frequency band.

A problem in prior art antenna devices is thus to provide a multi-band antenna with a small size and volume and broad frequency bands which retains good performance.

The international patent publication WO 01/20718 A1 discloses an antenna arrangement, wherein a controllable switching arrangement is provided to change the electrical characteristic of a radiating element. This is primarily to adapt the antenna's own properties to different hand positions on the phone, optimising the handset performance. A control signal input is directly connected to the switching arrangement via inductive and capacitive elements.

SUMMARY OF THE INVENTION

An object of the present invention is to provide an antenna device of the kind initially mentioned wherein the frequency characteristics provides for at least two comparatively wide frequency bands while the overall size of the antenna device is small.

Another object is to provide an antenna device having better multi-band performance than prior art devices.

The invention is based on the realization that several frequency bands can be provided in a physically very small antenna by arranging the antenna so that in at least two frequency modes the antenna utilizes the first resonance of the antenna structure. This is made possible by providing two radiating elements selectively interconnectable by means of a switch between the radiating elements. A purely resistive filter arrangement blocking RF signals is arranged between one of the radiating elements and a DC control input. According to a first aspect of the present invention there is provided an antenna device as defined in claim 1.

According to a second aspect of the present invention there is provided a portable radio communication device as defined in claim 10.

Further preferred embodiments are defined in the dependent claims.

The invention provides an antenna device and a portable radio communication device wherein the problems in prior art devices are avoided or at least mitigated. Thus, there is provided a multi-band antenna device having an antenna volume as small as about 2 $cm^3$ which means that the size of the antenna is remarkably reduced compared to standard multi-band patch antennas but still with maintained RF performance. Also, the bandwidths of the antenna device according to the invention can be improved compared to corresponding prior art devices but without any increase in size, which is believed to be a result of the use of the basic frequency mode of the antenna structure. As an example thereof, bandwidths of as much as 15% of the centre frequency of the higher frequency band have been obtained as compared to 9-10% in conventional prior art antenna devices.

The filter is preferably a low-pass filter, providing an efficient RF blocking arrangement. By providing the filter integral with the radiating element, better performance is obtained.

The switch is preferably a PIN diode, having good properties when operating as an electrically controlled switch.

BRIEF DESCRIPTION OF DRAWINGS

The invention is now described, by way of example, with reference to the accompanying drawings, in which.

DETAILED DESCRIPTION OF THE INVENTION

In the following, a detailed description of preferred embodiments of an antenna device according to the invention will be given. In the description, for purposes of explanation and not limitation, specific details are set forth, such as particular hardware, applications, techniques etc. in order to provide a thorough understanding of the present invention. However, it will be apparent to one skilled in the art that the present invention may be utilized in other embodiments that depart from these specific details. In other instances, detailed descriptions of well-known methods, apparatuses, and circuits are omitted so as not to obscure the description of the present invention with unnecessary details.

Figure 1:
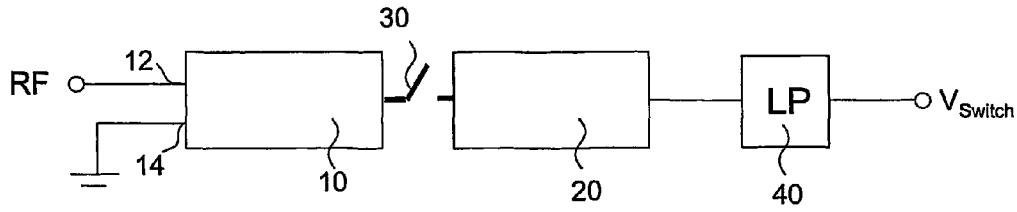
FIG. 1 shows a schematic diagram of a PIFA antenna device according to the invention.

In FIG. 1, there is shown an antenna device, generally designated 1. The antenna device comprises a first generally planar rectangular radiating element 10 made of an electrically conductive material, such as a sheet metal or a flex film, as is conventional. A source RF of radio frequency signals, such as electronic circuits of a portable radio communication device, is connected to a feeding portion 12 of the first radiating element. A ground device of the portable radio communication device in which the antenna device is mounted is connected to the first antenna element via a grounding portion 14. In the preferred embodiment, both the feeding portion 12 and the grounding portion 14 are arranged at the same edge of the first radiating element and preferably at a short edge thereof.

The antenna device also comprises a second generally planar rectangular radiating element 20. A switch element 30 is provided between the two radiating elements 10, 20. This switch element is preferably a PIN diode, i.e., a silicon junction diode having a lightly doped intrinsic layer serving as a dielectric barrier between p and n layers. Ideally, a PIN diode switch is characterized as an open circuit with infinite isolation in open mode and as an short circuit without resistive losses in closed mode, making it suitable as an electronic switch. In reality the PIN diode switch is not ideal. In open mode the PIN diode switch has capacitive characteristic (0.1-0.4 pF) which results in finite isolation (15-25 dB @ 1 GHz) and in closed mode the switch has resistive characteristic (0.5-3 ohm) which results in resistive losses (0.05-0.2 dB).

Figure 1A:
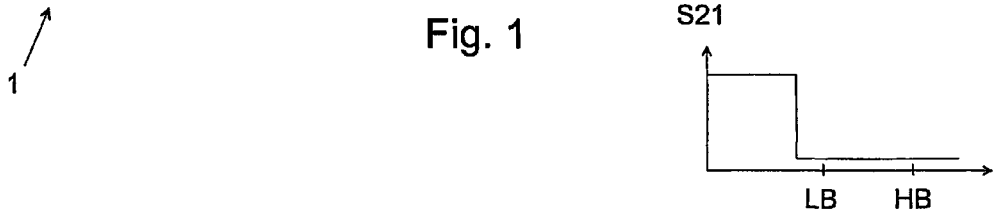
FIG. 1*a* is a diagram showing the filter characteristics of the filter shown in FIG. 1.

A DC control input for controlling the operation of the PIN diode, designated $V_{Switch}$ in the figures, is connected to the second radiating element 20 via a filter block 40 to not affect the RF characteristics of the antenna device. This means that the filter characteristics of the filter block 40 is designed so as to block RF signals, i.e., allows only signals having a frequency below the lower frequency band LB, see the filter characteristics in FIG. 1*a*. In the preferred embodiment, the filter block 40 comprises a low pass filter.

Figure 2:
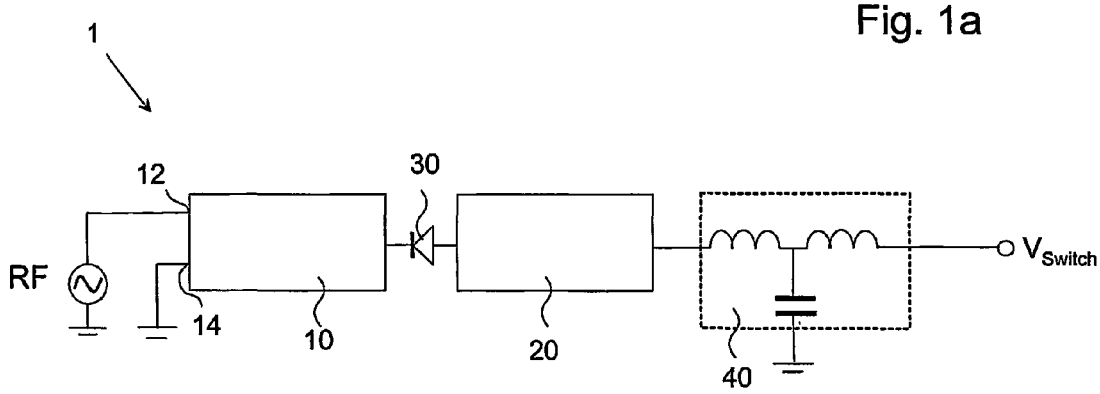
FIG. 2 is a more detailed diagram of the antenna device shown in FIG. 1.

A more detailed diagram of the antenna device is shown in FIG. 2. It is here shown that the low pass filter block 40 consists of two inductors and one capacitor arranged between the two inductors and ground. The antenna is preferably designed to 50 Ohms.

Figure 3:
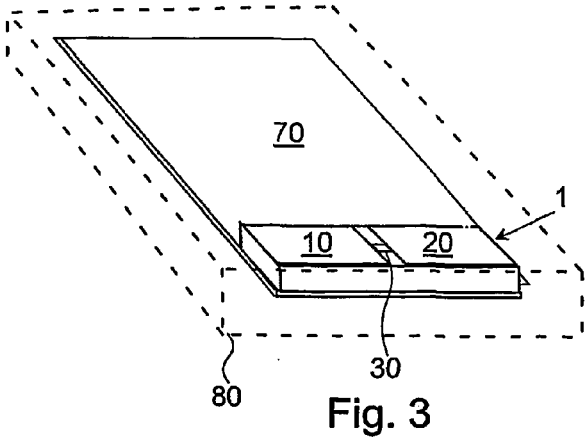
FIG. 3 is an overview of a printed circuit board arranged to be fitted in a portable communication device and having an antenna device according to the invention.

In FIG. 3 the two radiating elements 10, 20 are shown arranged generally parallel to and spaced apart from a printed circuit board (PCB) 70 adapted for mounting in a portable communication device 80, such as a mobile phone. The general outlines of the communication device is shown in dashed lines in FIG. 3. Typical dimensions for the antenna device 1 is a height of approximately 4 millimetres and a total volume of about 3 $cm^3$ or even less than 2 $cm^3$.

It will be appreciated that all components except for the two radiating elements 10, 20 and the switch element 30 can be provided on the PCB, thus facilitating easy assembly of the antenna device. This is further facilitated by the fact that there is no separate feeding of the switch element.

The antenna device functions as follows. The RF source and other electronic circuits of the communication device 80 operate at a given voltage level, such as 1.5 Volts. The criterion is that the voltage level is high enough to create the necessary voltage drop across the PIN diode, i.e. about 1 Volt. This means that the control voltage $V_{Switch}$ is switched between the two voltages "high" and "low", such as 1.5 and 0 Volts, respectively. When $V_{Switch}$ is high, there is a voltage drop across the PIN diode 30 and a corresponding current therethrough of about 5-15 mA. This voltage drop makes the diode conductive, effectively electrically interconnecting the two radiating elements 10, 20.

With the two radiating elements interconnected, i.e., with the switch element "closed", both radiating elements are active working as one large element with a resonance frequency corresponding to a lower frequency band.

With the control voltage $V_{Switch}$ "low", there is an insufficient voltage drop across the PIN diode 30 to make it conductive, i.e., it is "open". The second radiating element is then effectively disconnected from the first one and only the first radiating element functions as one small element with a higher resonance frequency corresponding to a higher frequency band.

The size and configuration of the two radiating elements are chosen so as to obtain the desired resonance frequencies. Thus, the size and configuration of the first radiating element 10 determines the resonance frequency of the higher frequency band while the combination of the first and second radiating elements 10 and 20 determines the resonance frequency of the lower frequency band. In a preferred embodiment, the two radiating elements are of similar configuration so as to cover the 900 and 1800/1900 MHz bands.

A conventional production method of antenna devices is to provide an electrically conductive layer forming the radiating portions of the antenna on a carrier made of a non-conductive material, such as a polymer or other plastic material. The carrier is thus made of a heat-sensitive material and a small heating area is desired to keep the temperature as low as possible when soldering components to the antenna device.

Figure 4:
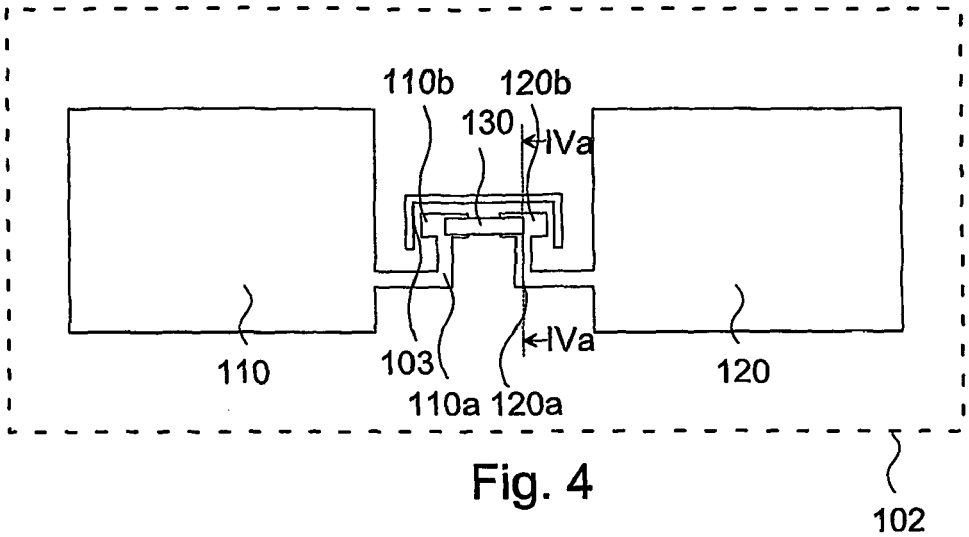
FIG. 4 shows an alternative radiating element configuration.

In FIG. 4 there is shown an alternative configuration of the radiating elements, combining soldering pads for a PIN diode with heat traps for efficient soldering operation while providing a large overall distance between the two radiating elements. Each of the radiating elements 110, 120 comprises a narrow portion 110*a*, 120*a* protruding from the otherwise generally rectangular shape. The protruding portions end in a respective pad 110*b*, 120*b* to which a switching element in the form of a PIN diode 130 is mounted by means of soldering, for example. By means of this configuration, interference between the two radiating elements are minimised as the general mutual distance therebetween is larger than in the embodiment described with reference to FIGS. 1-3. In order to keep the interference between the radiating elements at acceptable levels, it has been found that they should be separated by at least 3 millimetres, and preferably more. Also, by providing the connection portions in the form of pads separated from the main radiating elements by narrow connection portions, heating energy for soldering is kept low, thus minimising damage to the carrier structure.

Figure 4A:
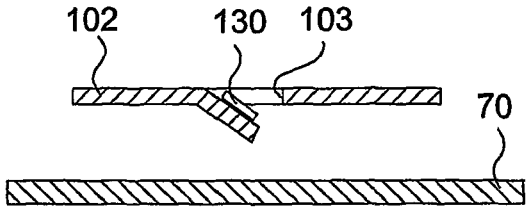
FIG. 4*a* shows a cross-sectional view along the line IVa-IVa of the radiating element shown in FIG. 4.

In order to minimise the overall height of the antenna device, thereby saving space in the radio communication device in which the antenna device is mounted, an essentially C-shaped slit 103 is provided in the carrier 102 around the area in which the PIN diode is mounted. By means of this slit, the area of the carrier in which the PIN diode is provided can be depressed, see the cross-sectional view of FIG. 4*a*. The PIN diode is provided so that it is below the upper surface of the carrier 102, thus maintaining an overall height of the antenna arrangement essentially corresponding to the distance between the radiating elements 110, 120 and the PCB 70.

Figure 5:
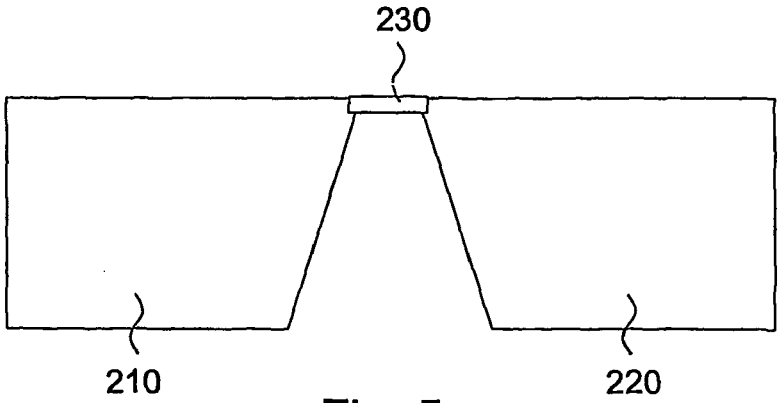
FIG. 5 shows yet an alternative radiating element configuration.

In an alternative embodiment shown in FIG. 5, the mutual distance between the two radiating elements 210, 220 is kept large due to the non-rectangular configuration of the elements. In FIG. 5 the edges of the radiating elements facing each other are diverging from the portion where the PIN diode 230 interconnects the two radiating elements.

Figure 6:
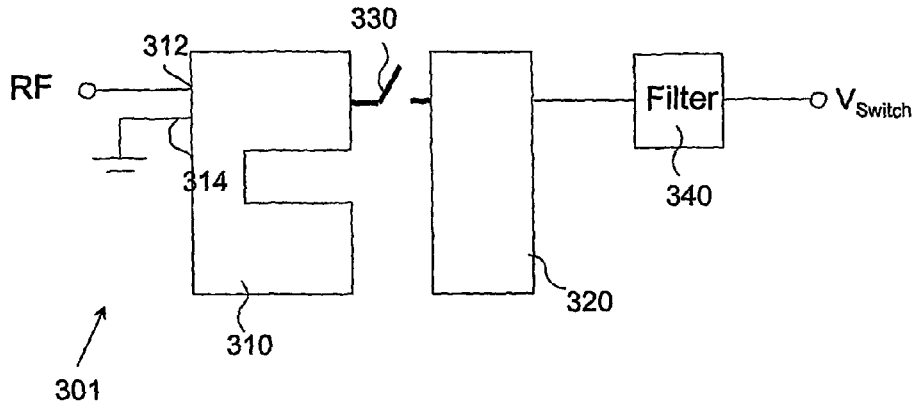
FIG. 6 shows an alternative embodiment operable in three or four frequency bands wherein one radiating element provides for two resonance frequencies by itself.

The first radiating element can itself have a configuration that provide for more than one frequency band, thus providing for operation in three or four frequency bands. An example thereof is shown in FIG. 6, wherein the first radiating element 310 has a general C shape, providing for two resonance frequencies by itself. Except for the shape of the first antenna element, this embodiment is similar to the one shown in FIG. 1. The first antenna element thus comprises a feeding portion 312 connected to a source of RF signals and a grounding portion 314 connected to a ground device. A second antenna element 320 is connected to the first antenna element by means of a switch 330 and to a DC signal $V_{Switch}$ via a filter 340.

Thus, with the switch 330 open, i.e., non-conductive, the antenna device operates in two frequency bands: a lower band centred around 850 or 900 MHz depending on the configuration of the first antenna element 310 and an upper band centred around 1900 MHz. With the switch closed, i.e., conductive, both the first and the second antenna elements 310, 320 together operate in a frequency band centred around 1800 MHz.

Four band operation could be provided if also the lower frequency band changes when the switch is closed, e.g., between the 850 and 900 MHz bands.

Figure 6A:
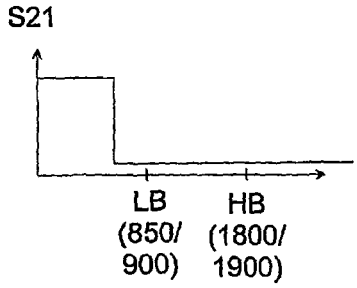
FIG. 6*a* is a diagram showing a filter characteristics of the filter shown in FIG. 6.
Figure 6B:
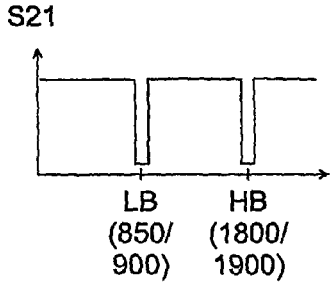
FIG. 6*b* is a diagram showing an alternative filter characteristics of the filter shown in FIG. 6.

The filter 340 is preferably provided as a low pass filter blocking signals at all the frequency bands, see the filter characteristics shown in FIG. 6*a*. Alternatively, the filter is provided as a band stop filter also blocking signals in all the frequency bands, see FIG. 6*b*.

Figure 7:
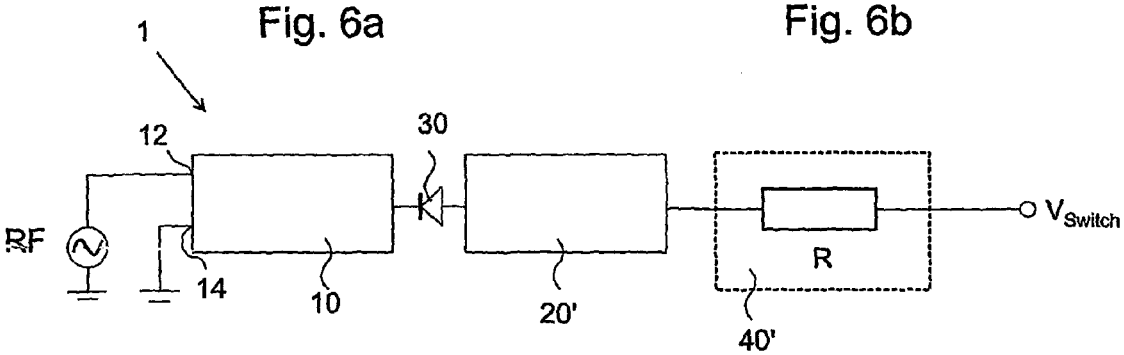
FIG. 7 shows the antenna device according to the invention wherein the filter is provided as a pure resistor.

The low pass filter block 40 has been shown in FIG. 2 as comprising capacitors and inductors. In an alternative embodiment shown in FIG. 7, the capacitors and inductors are replaced by a pure resistor in the filter block, i.e., the impedance of the filter block 40' shown in FIG. 7 is purely resistive (R). In all other aspects this embodiment is identical to the one shown in FIG. 2. Due to the low DC current required to switch the PIN diode, a high resistance can be used as a filter, such as 800 Ohms. This in turn unexpectedly provides a filter blocking RF signals.

Figure 7A:
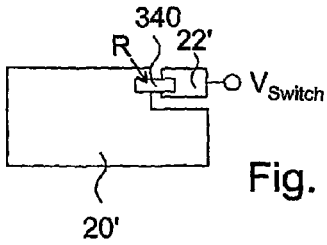
FIG. 7*a* shows the configuration of the filter of FIG. 7.

The filter block 40' having a purely resistive impedance is preferably provided integrated with the radiating element 20 itself. An example of this is shown in FIG. 7*a*, wherein a detailed view of the radiating element 20' of FIG. 7 having a resistor R interconnected between the radiating element and a pad 22' is shown. The pad in turn is connected to the control signal input $V_{Switch}$. This provides a solution wherein even fewer components are required in the antenna device. Also, by providing the resistive impedance integrated with the radiating element 20', thereby blocking RF signals close to the radiating element, and not on an underlying printed circuit board, better performance is obtained. In an alternative embodiment (not shown), the resistive impedance is provided on the circuit board.

It will be appreciated that this purely resistive impedance can be used in the filter 340 shown in FIG. 6 as well.

Preferred embodiments of an antenna device according to the invention have been described. However, it will be appreciated that these can be varied within the scope of the appended claims. Thus, a PIN diode has been described as the switch element. It will be appreciated that other kinds of switch elements can be used as well.

The radiating elements have been described as being essentially planar and generally rectangular. It will be appreciated that the radiating elements can take any suitable shape, such as being bent to conform with the casing of the portable radio communication device in which the antenna device is mounted.

One switch has been shown to interconnect the two radiating elements. It will be appreciated that more than one switch, such as several parallel PIN diodes can be used without deviating from the inventive idea.

The invention claimed is:

1. An antenna device for a portable radio communication device operable in at least a first and a second frequency band, the antenna device comprising:

a first electrically conductive radiating element having a first edge, a feeding portion connectable to a radio frequency feed device of the radio communication device and a grounding portion connectable to a ground device;

a second electrically conductive radiating element having a first edge and a second edge;

a controllable switch comprising a diode between the first edge of the first radiating element and the first edge of the second radiating element for selectively interconnecting and disconnecting the radiating elements, the state of the switch being controlled by means of a control voltage input; and a passive filter comprising a resistor and electrically connected directly to only the second edge of the second radiating element and the control voltage input such that the filter has purely resistive impedance, wherein the filter is arranged to block radio frequency signals when a current level through the diode is between about 5 milliamps and about 15 milliamps such that the diode is conductive and electrically interconnecting the radiating elements.

2. The antenna device according to claim 1, wherein the state of the switch is controlled for transmitting and receiving signals in the first frequency band and for transmitting and receiving signals in the second band.

3. The antenna device according to claim 1, wherein the filter is a low pass filter blocking signals at frequencies equal to and higher than the lower frequency band of said at least a first and a second frequency bands.

4. The antenna device according to claim 1, wherein the filter is a band stop filter blocking signals in both a lower and a higher frequency band of said at least a first and a second frequency bands.

5. The antenna device according to claim 1, wherein the first radiating element has a configuration that provides for more than one resonance frequency.

6. The antenna device according to claim 1, wherein at least one of the first and second radiating elements comprises a protruding portion, and wherein the switch is connected to the protruding portion.

7. The antenna device according to claim 1, comprising a generally planar printed circuit board, wherein the first and second radiating elements and the switch are arranged generally parallel to and spaced apart from the printed circuit board.

8. The antenna device according to claim 1, wherein the state of the diode is controllable by using the electrical current running through the second radiating element.

9. The antenna device according to claim 1, wherein the filter is integrated with the second radiating element.

10. A portable radio communication device, comprising a generally planar printed circuit board and an antenna device connected to a radio frequency feed device with electronic circuits provided for transmitting and/or receiving RF signals, and a ground device, wherein the antenna device comprises:

a first electrically conductive radiating element having a first edge, a feeding portion connected to the radio frequency feed device of the radio communication device and a grounding portion connected to the ground device;

a second electrically conductive radiating element having a first edge and a second edge;

a controllable switch comprising a diode arranged between the first edge of the first radiating element and the first edge of the second radiating element for selectively interconnecting and disconnecting the radiating elements, the state of the switch being controlled by means of control voltage input; and a passive filter comprising a resistor and electrically connected directly to only the second edge of the second radiating element and the control voltage input such that the filter has a purely resistive impedance, and wherein the filter is arranged to block radio frequency signals when a current level through the diode is between about 5 milliamps and about 15 milliamps such that the diode is conductive and electrically interconnecting the radiating elements.

11. The antenna device according to claim 1, wherein the filter does not include any capacitors or inductors and the filter includes only the resistor.

12. The antenna device according to claim 1, wherein the filter is substantially coplanar with the second edge of the second radiating element.

13. The antenna device according to claim 1, wherein the resistor is a pure resistor, and wherein the filter consists only of the pure resistor such that the impedance of the filter is entirely purely resistive.

14. The antenna device according to claim 1, wherein the control voltage input is connected to the second radiating element by the filter, wherein the first radiating element comprises a generally planar rectangular element having a pair of opposing short edges and a pair of opposing long edges, wherein the first edge is one of the opposing short edges, and wherein the feeding portion and grounding portion are arranged at the other one of the opposing short edges.

15. The antenna device according to claim 1, wherein only the filter is arranged between the second radiating element and the control voltage input, such that there are no inductors or capacitors arranged between the second radiating element and the control voltage input.

16. A portable radio communication device comprising the antenna device according to claim 1.

17. The portable radio communication device according to claim 10, wherein the filter does not include any capacitors or inductors and the filter includes only the resistor.

18. The portable radio communication device according to claim 10, wherein the state of the diode is controllable by using the electrical current running through the second radiating element.

19. A method of operating an antenna device in a portable radio communication device operable in at least a first and a second frequency band, the antenna device including a first electrically conductive radiating element having a first edge, a feeding portion connectable to a radio frequency feed device of the radio communication device and a grounding portion connectable to a ground device; a second electrically conductive radiating element having a first edge and a second edge, a controllable switch comprising a diode between the first edge of the first radiating element and the first edge of the second radiating element for selectively interconnecting and disconnecting the radiating elements, the state of the switch being controlled by means of a control voltage input, the method comprising filtering the control voltage input with a passive filter having a purely resistive impedance and electrically connected directly to only the second edge of the second radiating element and the control voltage input, whereby the passive filter is operable for blocking radio frequency signals when a current level through the diode is between about 5 milliamps and about 15 milliamps such that the diode is conductive and electrically interconnecting the radiating elements.

20. The method of claim 19, wherein the filter includes only a pure resistor, and wherein filtering the control voltage input includes filtering the control voltage input only with the pure resistor, without using any capacitors or inductors.

* * * * *